US005905471A

United States Patent [19]

Biebl et al.

[11] Patent Number: 5,905,471

[45] Date of Patent: May 18, 1999

[54] ACTIVE RECEIVING ANTENNA

[75] Inventors: Erwin Biebl, Germering; Johann-Friedrich Luy, Ulm, both of Germany

[73] Assignee: Daimler-Benz Aktiengesellschaft, Stuttgart, Germany

[21] Appl. No.: 08/891,824

[22] Filed: Jul. 14, 1997

[30] Foreign Application Priority Data

Jul. 12, 1996 [DE] Germany ..... 196 28 125

[51] Int. Cl.[6] ..... H01Q 13/12

[52] U.S. Cl. ..... 343/769; 343/712; 343/767; 343/789

[58] Field of Search ..... 343/769, 767, 343/771, 789, 711, 712, 713, 700 MS

[56] References Cited

U.S. PATENT DOCUMENTS

| | | | |
|---|---|---|---|
| 4,208,660 | 6/1980 | McOwen, Jr. | 343/769 |
| 4,721,963 | 1/1988 | Nagy et al. | 343/712 |
| 4,821,040 | 4/1989 | Johnson et al. | 343/769 |
| 5,194,876 | 3/1993 | Schnetzer et al. | 343/769 |
| 5,239,669 | 8/1993 | Mason et al. | 343/769 |
| 5,471,664 | 11/1995 | Kim | 455/323 |
| 5,489,913 | 2/1996 | Raguenet et al. | 343/767 |
| 5,539,420 | 7/1996 | Dusseux et al. | 343/769 |
| 5,714,961 | 2/1998 | Kot et al. | 343/769 |

FOREIGN PATENT DOCUMENTS

| | | |
|---|---|---|
| 41 20 521 A1 | 9/1992 | Germany . |
| 690 08 116 T2 | 7/1994 | Germany . |
| 06283923 | 10/1997 | Japan . |
| 2 251 520 | 7/1982 | United Kingdom . |

OTHER PUBLICATIONS

Pozar, D.M.: "A Reciprocity Method of Analysis for Printed Slot and Slot–Coupled Microstrip Antennas", IEEE Transactions on Antennas and Propagation, vol. Ap–34, No. 12, Dec. 1986, pp. 1439–to 1446.

Bashir et al., "Flache Kombiantenne für GSM und GPS", *Funkschau,* Feb. 1995, pp. 60–62.

*Primary Examiner*—Don Wong
*Assistant Examiner*—Tan Ho
*Attorney, Agent, or Firm*—Venable; Norman N. Kunitz

[57] ABSTRACT

An active receiving antenna for vehicles, including a slot-shaped antenna cut into the metallic vehicle body, and having small-depth cavity filled with a dielectric material which closes off the antenna toward the back or interior of the vehicle. A low-noise preamplifier, which is integrated into the dielectric material, is connected to the antenna via two feed lines of different length. The desired polarizations of the received signals are set via this preamplifier, which can be changed over and be switched off.

8 Claims, 1 Drawing Sheet

ACTIVE RECEIVING ANTENNA

REFERENCE TO RELATED APPLICATIONS

This application claims the priority of German Application No. 196 28 125.3, filed Jul. 12, 1996, which is incorporated herein by reference.

BACKGROUND OF THE INVENTION

The invention relates to a slot antenna arrangement including a slot formed in a metal surface, with the slot being closed off toward the rear by a cavity filled with a dielectric material.

The slot antenna is used for receiving satellite signals, e.g., for navigating, as well as in land vehicles, watercraft and aircraft.

For receiving antennas of this type, slot antennas with radiation field coupling are suitable which, for example, have a feed line on the back side of a substrate (B. D. M. Pozar, IEEE Trans. Antennas Prop. Vol. AP-34, No. 12, p. 1439–1446 (1996)).

From the Japanese patent application 0 6283923A, a slot antenna having a cavity formed from a dielectric material is known, with the slot of the antenna being cut into a conductive wall.

U.S. Pat. No. 5,489,913 discloses a slot antenna with a cavity, with the antenna having very small dimensions. Different polarized waves are received via different slot arrangements with corresponding coupling structures.

SUMMARY OF THE INVENTION

It is the object of the present invention to provide a high-powered slot antenna arrangement with which different polarized waves are received and which can be easily adapted to a vehicle body.

The above object generally is achieved according to the present invention by a slot antenna arrangement which is used as receiving aerial for differently polarized waves and which is closed off from the rear by a cavity filled with a dielectric material, and wherein: the slot antenna is connected in-phase with a low-noise preamplifier via a pair of feed lines for coupling of the slot structure such that a specific phase position of the received waves is set via different lengths of the feed lines, and the preamplifier and the feed lines are placed or inserted in the cavity. Advantageous embodiments and/or modifications of the basic invention are disclosed and discussed.

The slot antenna arrangement according to the invention has the advantage that excellent receiving results are accomplished by means of the integrated, low-noise preamplifier (LNA) which can be changed over and be switched off. By means of the LNA, which can be changed over and be switched off, the antenna can receive waves which are polarized in a circular and linear manner. Also advantageous are the flat, mechanically robust configuration of the antenna as well as its invisible and aerodynamically optimum arrangement in the vehicle body.

The invention is described below by way of an embodiment with reference to schematic drawings.

DETAILED DESCRIPTION OF THE PREFERRED EMBODIMENTS

Figure 1:
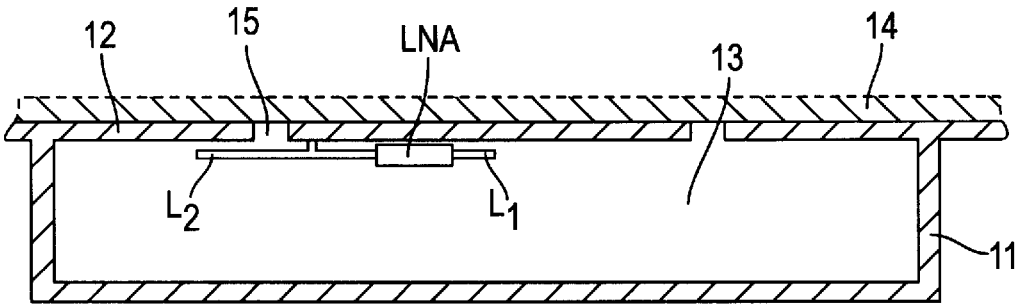
FIG. 1 is a schematic cross-sectional view along the line 1—1 of FIG. 2 of a slot antenna arrangement according to the invention.

According to FIG. 1, the antenna is cut as a slot-shaped recess or opening 15 in a metal surface 12, e.g., the metal body of a vehicle. To prevent rearward radiation, the antenna is closed off from the back by a cavity 11 having a small or shallow depth. As can be seen, the slot-shaped recess 15 is formed in one of the walls defining the cavity 11. The cavity 11 is filled with a dielectric material 13, e.g., teflon, polystyrene or a similar material. A low-noise preamplifier (LNA) is connected or coupled in a conventional manner, with the antenna slot 15 through feed lines $L_1$, $L_2$ of different lengths, so that, for example, during the reception of circularly polarized waves, the addition of the two linear polarization states which are displaced or turned by 90° takes place in the LNA. The correct phase position of the waves is set via the different lengths of the feed lines $L_1$, $L_2$. The LNA is placed or inserted into the dielectric material 13 and connected with the metallic body 12, which serves as a ground plane, via the feed lines $L_1$, $L_2$. The entire antenna that is cut into the metal body 12 can be coated with a paint layer 14.

The power supply and the coupling out of the amplified signal takes place, e.g., via the lines $L_1$, $L_2$ placed or inserted into the dielectric material 13 within the cavity 11. Microstrip lines can be used for the lines $L_1$, $L_2$. This has the advantage that the design of the antenna is possible in sandwich technology. However, the use of coaxial lines for the lines $L_1$, $L_2$ offers the advantage that smaller electrical losses occur.

The contour of the slot-shaped recess of the antenna may be configured as a linear slot, an annular slot or a cone-shaped slot.

Figure 2:
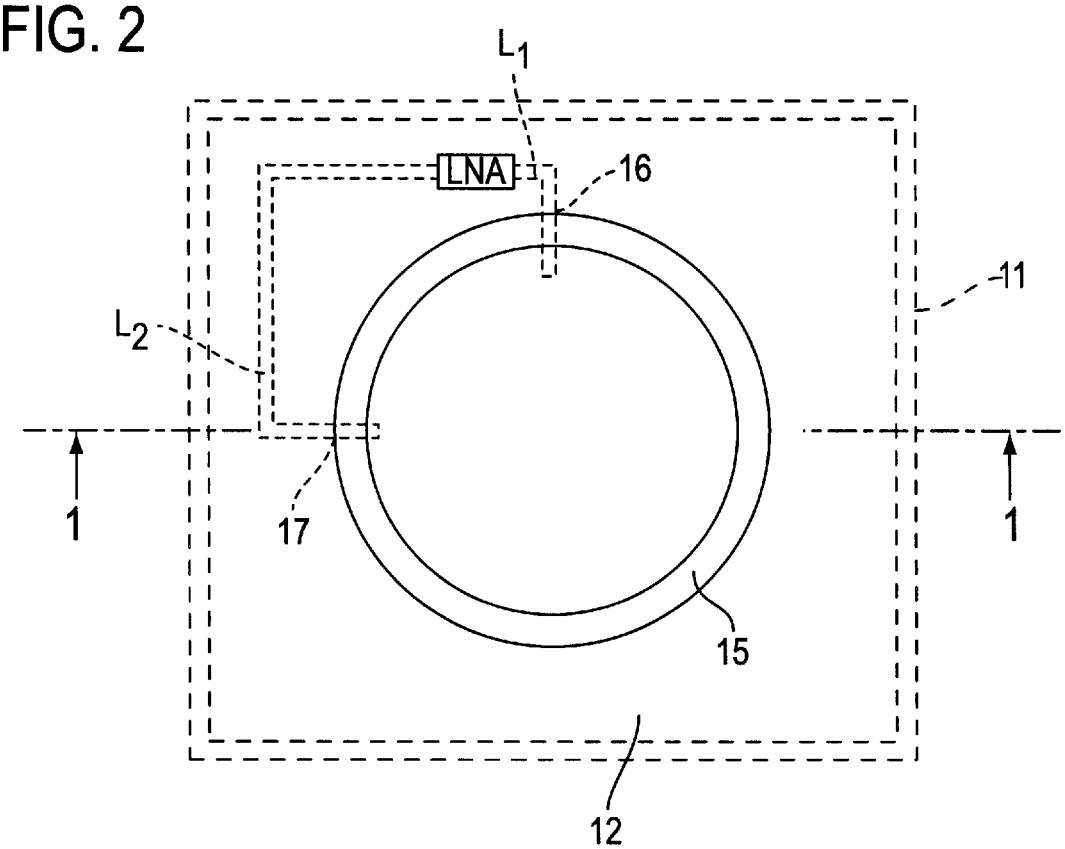
FIG. 2 is a plan view of a slot antenna according to the invention.

FIG. 2 illustrates, for example, a configuration of the slot-shaped recess as an annular slot 15. The rearward cavity 11 has a depth of, for example, 1 mm. The feed lines $L_1$, $L_2$ are, for example, microstrip lines having a length of $L_1=\lambda/4\sqrt{\epsilon r}$ and $L_2=\lambda/\sqrt{\epsilon r}$ at a wavelength of, for example, $\lambda=18.75$ cm (corresponds to a frequency of f=1.6 GHz).

The cross sectional surface of the cavity of the antenna is designed as a function of the shape of the slot antenna since the shape determines the resonance frequency of the antenna. For example, with an annular slot shaped recess 15, the cross section of the cavity 11 may be square as shown in FIG. 2.

All components are configured to be flush with the surface of the metallic vehicle body 12. Thus, the antenna can be painted over and is therewith not visible. Since, for the slot antenna, the entire metal surface (e.g., the entire vehicle roof) surrounding the antenna is active as a ground surface, an almost semispherically-shaped isotropic directional pattern is accomplished, as is necessary for the intended applications. By integrating the antenna structure into a convex surface (vehicle shell), a kidney-shaped antenna radiation pattern or antenna characteristic can be achieved.

The slot-antenna arrangement 15 has a resonance at the operating frequency. On the other hand, the cavity resonator 11 is dimensioned such that it is not resonant at the operating frequency. With this, the cavity resonator 11 is nearly field-free. The mode of operation of the cavity resonator, which is outside of the resonance, is based on the fact that the rear of the slot antenna 15 ends in an open circuit.

The slot antenna arrangement 15 is supplied with power through direct contacting 16, 17 of the slot structure at 16 and 17 as shown in FIG. 2.

The amplified output signals from the antenna arrangement are decoupled via the lines L1, L2 that are placed in and extend through the dielectric material 13.

With the disclosed arrangement, the addition of, for example, two orthogonal electromagnetic waves with linear polarization, which are phase-displaced by 90° to produce circular, polarized signals occurs in the LNA. Since the addition occurs in the LNA, it is possible to set any optional polarization through varied weighting of the two phase-displaced portions and a phase rotation of 180°.

The invention now being fully described, it will be apparent to one of ordinary skill in the art that any changes and modifications can be made thereto without departing from the spirit or scope of the invention as set forth herein.

What is claimed:

1. A slot antenna arrangement which is used as a receiving antenna for differently polarized waves comprising:

a slot shaped recess formed in a metal surface which defined one wall of a shallow cavity disposed at and closing off a rear of the slot-shaped recess;

a dielectric material filling the cavity;

a low noise preamplifier;

a pair of feed lines ($L_1$, $L_2$) for coupling the slot-shaped recess in-phase to the low-noise preamplifier, with the pair of feed lines having different lengths to set a specific phase position of the waves received by the antenna; and the preamplifier and the feed lines are disposed in the dielectric material within the cavity.

2. A slot antenna arrangement according to claim 1, wherein the metal surface is part of a vehicle body.

3. A slot antenna arrangement according to claim 1, wherein the slot antenna is configured as annular slot.

4. A slot antenna arrangement according to claim 1, wherein the respective feed lines ($L_1$, $L_2$) are microstrip lines.

5. A slot antenna arrangement according to claim 1, wherein the respective feed lines ($L_1$, $L_2$) are coaxial lines.

6. A slot antenna arrangement according to claim 1, whereinthe cross sectional surface of the cavity is configured according to the shape of the slot-shaped recess antenna and that the cavity has a depth of approximately 1 mm.

7. A slot-antenna arrangement as defined in claim 6 wherein the slot antenna is configured as an annular slot and wherein the cavity has a square cross section.

8. A slot antenna arrangement according to claim 1 wherein the metal surface is part of a vehicle body and further comprising a layer of paint covering the outer surface of the vehicle body including the slot-shaped recess.

* * * * *